US006974388B1

(12) United States Patent
Williams, Jr.

(10) Patent No.: US 6,974,388 B1
(45) Date of Patent: Dec. 13, 2005

(54) SAIL FOR A SWING

(76) Inventor: Clayton M. Williams, Jr., 427 Tramway Dr., Charleston, SC (US) 29414

( * ) Notice: Subject to any disclaimer, the term of this patent is extended or adjusted under 35 U.S.C. 154(b) by 0 days.

(21) Appl. No.: 10/723,880

(22) Filed: Nov. 26, 2003

(51) Int. Cl.[7] ..... A63G 9/02
(52) U.S. Cl. ..... 472/118; 472/125
(58) Field of Search ..... 472/118–125; 297/273, 276, 277, 278, 280, 281; D21/823–825

(56) References Cited

U.S. PATENT DOCUMENTS

| | | | | | |
|---|---|---|---|---|---|
| 646,802 | A | * | 4/1900 | Bultmann | 472/122 |
| 743,546 | A | * | 11/1903 | Nix | 297/276 |
| 860,156 | A | * | 7/1907 | Scalf | 5/109 |
| 1,490,619 | A | * | 4/1924 | Manikowske et al. | 472/120 |
| 2,300,586 | A | | 11/1942 | Meehan | |
| 2,353,220 | A | | 7/1944 | Charlop | |
| 2,839,123 | A | * | 6/1958 | Summitt | 297/42 |
| 2,848,229 | A | | 8/1958 | Miller | |
| D248,518 | S | | 7/1978 | Huff | |
| D260,110 | S | | 8/1981 | Gomes | |
| D264,148 | S | | 5/1982 | Gebhard | |
| 4,351,524 | A | | 9/1982 | Gomes | |
| 4,898,198 | A | | 2/1990 | Castlebury | |
| 5,529,539 | A | * | 6/1996 | Hoffman | 472/118 |
| 5,766,084 | A | * | 6/1998 | Smith | 472/120 |
| 5,788,327 | A | * | 8/1998 | Gregory | 297/273 |
| 5,842,741 | A | | 12/1998 | Onorini | |
| 5,938,283 | A | * | 8/1999 | Babcock et al. | 297/273 |
| 5,957,780 | A | | 9/1999 | Grazioli | |
| 6,001,021 | A | | 12/1999 | Battaglia | |
| D455,908 | S | | 4/2002 | Liu | |
| 6,383,085 | B1 | | 5/2002 | Tseng | |
| D459,099 | S | | 6/2002 | Liu | |
| 6,402,233 | B1 | | 6/2002 | Tseng | |

* cited by examiner

*Primary Examiner*—Kien Nguyen
(74) *Attorney, Agent, or Firm*—B. Craig Killough

(57) ABSTRACT

A swing with a sail is disposed between lines or chains from which the swing is suspended. The sail is disposed above the heads of the occupants of the swing when the occupants are seated in the swing. A large plane of the sail is suspended generally vertically, so that the sail's large surface area disrupts and moves the air as the swing moves back and forth, so as to create a cooling breeze. The sail is removably mounted to the chains or lines.

14 Claims, 1 Drawing Sheet

SAIL FOR A SWING

FIELD OF THE INVENTION

This invention relates to swings generally, and is more specifically directed to a sail that is disposed above a seat of the swing.

BACKGROUND OF INVENTION

Swings, and particularly bench-type swings, are typically used outdoors. Commonly, bench-type swings are mounted on porches, where the users are shielded from sun and other weather elements. Particularly in the summertime, or in warm climates, people sit on bench-type swings that are present on porches in order to enjoy the outdoors. A porch swing exposes the occupants to breezes that blow across the porch.

However, a breeze is not always available. There is a need for a swing that will generate or enhance air movement while the swing is in motion. It is preferred that the device for creating a breeze be relatively simple to install and use, and be set relatively simple to maintain. It is preferred that the device have no moving parts, other than the typical moving parts of the swing.

SUMMARY OF THE PRESENT INVENTION

The present invention is a swing with a sail. The sail is disposed between chains from which the swing is suspended. The sail is disposed above the heads of the occupants of the swing when the occupants are seated in the swing. A large plane of the sail is suspended generally vertically, so that the sail's large surface area disrupts and moves the air as the swings moves back and forth, so as to create a cooling breeze. The sail is removably mounted to the chains of the swing.

DETAILED DESCRIPTION OF THE PREFERRED EMBODIMENT

Figure 1:
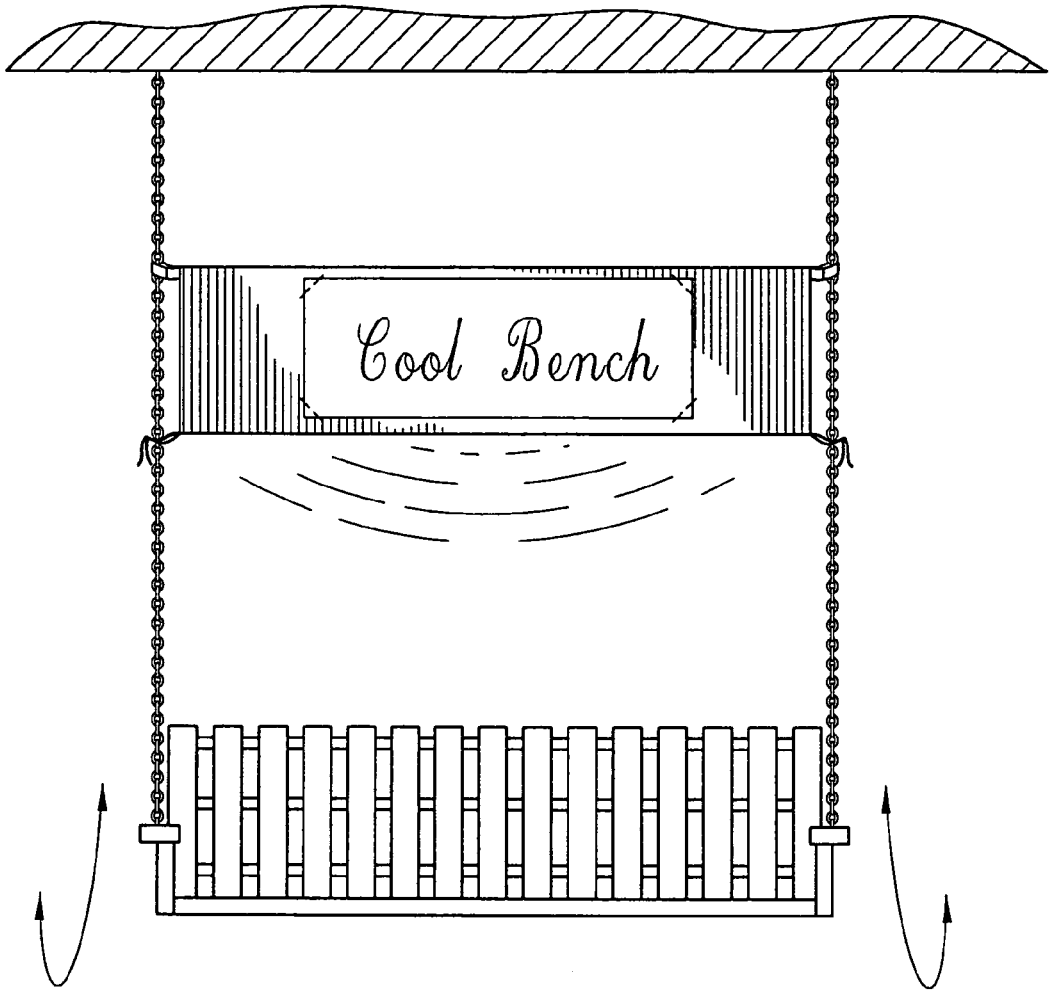
FIG. 1 is an elevation of a bench-type swing with the sail connected to, and disposed between, the chains from which the swing is suspended.

FIG. 1 shows a bench-type swing 2 that is suspended by chains 4,6 from a structure 8, which could be the ceiling of a porch. The bench-type swing has room for multiple occupants. In the preferred embodiment, and as commonly used in the prior art, the bench-type swing is suspended from chains having multiple links. However, the term "chains" as used herein means any elongated and flexible member having sufficient strength from which to suspend a swing, which includes both chain and lines, such as nylon lines or other flexible lines that could be used to mount a swing. However, metal chains having multiple links are preferred, since the links provide a convenient mounting point for the sail.

The sail 18 is disposed between the chains as shown in FIG. 1. The sail is preferred to be formed of fabric, which may be either woven or nonwoven fabric. The fabric may be any material that may be formed in a plane and which will resist and move the air. In particular, the sail may be formed of any material from which sails, such as those used with boats, are made. Examples are of suitable materials are cotton, polyester, polyester-cotton blends, sailcloth, nylon, Kevlar, canvas, or other woven and non-woven textiles that will resist and move air.

In the preferred embodiment, the sail is formed of a section of fabric. The section of fabric is preferred to be rectangular in shape. The use of the device with a bench-type swing means that the length of the sail is sufficient to cause substantial air movement. When the swing is in the static position, the large plane of the fabric is suspended generally vertically as shown in FIG. 1, and the length of the sail is such that the large plane of fabric is disposed between the chains for substantially the entire distance from the first chain to the second chain. In the preferred embodiment, the sail will have height of 30 cm to 50 cm. The sail is preferred to be mounted at least 35 cm above the heads of the occupants, but no more than 50 cm above the heads of the occupants. The sail should be mounted so that the lower edge is at least 120 cm above the top surface of the seat of the bench, but no more than 155 cm above the top surface of the seat of the bench. The sail may have designs, words, or other indicia 20 printed thereon, such as by silk-screening or digital printing.

Figure 2:
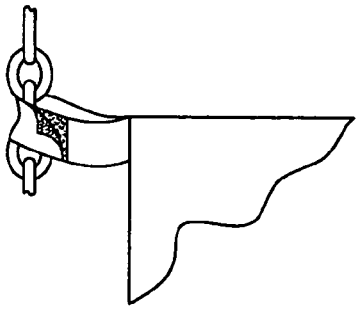
FIG. 2 is a partial view of the chain and the sail, demonstrating attachment of the sail to the chains by hook and loop material.
Figure 3:
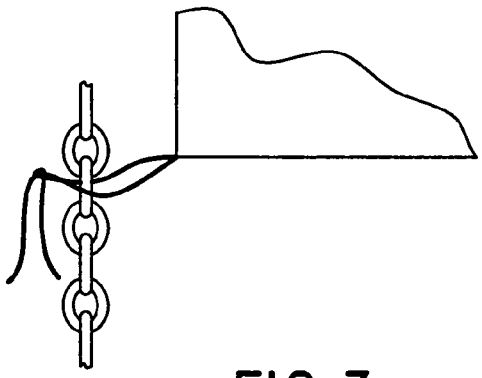
FIG. 3 is a partial view of the chain and the sail, demonstrating attachment of the sail to the chains by a line which is tied to, or around, the chains.

As shown in FIG. 1, the generally rectangular sail is mounted to the chains near an upper left corner of the sail, near an upper right corner of the sail, and near a lower left corner of the sail, and near a lower right corner of the sail. The sail is mounted to chains by lines. As shown in FIG. 2, the lines may be a pair of straps 10,12 that extend from the upper left corner of the sail. In particular, there are two straps at the corner, with one of the straps having hook and loop material near one end thereof, and the opposite strap having loop material near an end thereof. The straps may be looped around the chain, or preferably, through a link of the chain, and connected by means of hook and loop material. This means of connection may be used at all four corners of the device, or alternatively, may be used in combination with other securing means. FIG. 3 shows two lines 14,16 extending from a lower corner of the sail. At least one of the lines is preferably looped through the chain, and tied together to hold the sail in place. Again, the lines may be used at all four corners of the device, or straps having hook and loop material may be used at all four corners of the device, or the lines and straps may be used in combination, or with other means for securing the sail.

After the sail is mounted, the normal rocking motion of the swing as the swing is used will cause the sail to disrupt air. The disrupted air creates a breeze that is in close proximity to the occupants, and provides cooling for the occupants. On days where there is a substantial breeze, the sail will provide movement of the swing for the enjoyment of the occupants.

What is claimed is:

1. A swing and sail, comprising:

a) a swing that is suspended by at least two chains; and b) a sail that is laterally disposed between said chains and above said swing, wherein a large plane of said sail is positioned generally vertically when said swing is static, and wherein said sail is mounted to each of said at least two chains by at least two lines that are attached to said sail, and wherein each of said lines is removably attached to said chains.

2. A swing and sail as described in claim 1, wherein a first end of said sail is attached to a first of said at least two chains, and a second end of said sail is attached to a second of said at least two said chains.

3. A swing and sail as described in claim 1, wherein said large plane of said sail is comprised of fabric.

4. A swing and sail as described in claim 1, wherein a substantial portion of said large plane sail is generally rectangular.

5. A swing and sail as described in claim 1, wherein said sail is mounted to one of said at least two chains near a left upper side of said sail, and near a left lower side of said sail, and wherein said sail is mounted to a second of said at least two chains near a right upper side of said sail, and near a right lower side of said sail.

6. A swing and sail as described in claim 1, wherein said sail is mounted to each of said at least two chains at two points.

7. A swing and sail as described in claim 1, wherein said at least two lines are attached to said at least two chains by hook and loop material.

8. A swing and sail as described in claim 1, wherein said at least two lines are attached to said at least two chains by tying said at least two lines to said at least two chains.

9. A swing and sail as described in claim 1, wherein said swing is a bench type swing, wherein said bench type swing provides seating for at least two people.

10. A swing and sail as described in claim 1, wherein said sail is laterally disposed between said chains, and above said swing, and below a member from which said at least two chains are suspended.

11. A swing and sail as described in claim 1, wherein said swing is a bench type swing, and wherein said bench type swing provides seating for at least two people, and wherein said sail is laterally disposed between said chains, and above said swing, and below a member from which said at least two chains are suspended, and wherein said sail extends horizontally across substantially an entire distance between said chains.

12. A swing and sail, comprising:

a) a swing that is suspended by at least two chains; and b) a sail that is laterally disposed between said chains and above said swing, wherein a large plane of said sail is positioned generally vertically when said swing is static, wherein said swing is a bench type swing, and wherein said bench type swing provides seating for at least two people, and wherein said sail is laterally disposed between said chains, and above said swing, and below a member from which said at least two chains are suspended, and wherein said sail extends horizontally across substantially an entire distance between said chains where said sail attached to said chains, and wherein said large plane of said sail is comprised of fabric.

13. A swing and sail as described in claim 12, wherein said sail is mounted to each of said at least two chains by at least two lines that are attached to said sail.

14. A swing and sail, comprising:

a) a swing that is suspended by at least two chains; and b) a sail that is laterally disposed between said chains and above said swing, wherein a large plane of said sail is positioned generally vertically when said swing is static, wherein said swing is a bench type swing, and wherein said bench type swing provides seating for at least two people, and wherein said sail is laterally disposed between said chains, and above said swing, and below a member from which said at least two chains are suspended, and wherein said sail extends horizontally across substantially an entire distance between said chains, wherein said sail is mounted to each of said at least two chains by at least two lines that are attached to said sail.

* * * * *